US005301734A

United States Patent [19]

Opel

[11] Patent Number: 5,301,734

[45] Date of Patent: Apr. 12, 1994

[54] WINDOW MECHANISM

[75] Inventor: George E. Opel, Ambler, Pa.

[73] Assignee: Geo Ventures, Ambler, Pa.

[21] Appl. No.: 18,005

[22] Filed: Feb. 16, 1993

[51] Int. Cl.[5] ..... E06B 3/32; E05F 11/38

[52] U.S. Cl. ..... 160/100; 49/161; 49/358; 49/361; 49/362; 160/28

[58] Field of Search ..... 49/361, 362, 161, 358; 160/99, 100, 27, 28

[56] References Cited

U.S. PATENT DOCUMENTS

| | | | |
|---|---|---|---|
| 464,567 | 12/1891 | Hunter | 49/361 |
| 1,019,337 | 3/1912 | McConnell | 49/161 |
| 1,152,425 | 9/1915 | Lovell | 49/361 |
| 1,571,819 | 2/1926 | Toresan | 49/362 |
| 1,958,074 | 5/1934 | Seregi | 189/64 |
| 1,966,815 | 7/1934 | Fuller | 268/124 |
| 2,373,085 | 4/1945 | Ackerman et al. | 268/125 |
| 2,539,822 | 1/1951 | Fuller | 49/361 |
| 2,545,449 | 3/1951 | Curley | 268/122 |
| 2,621,540 | 12/1952 | Rath | 74/626 |
| 2,625,218 | 1/1953 | Nihon | 160/103 |
| 2,675,228 | 4/1954 | Baird et al. | 268/21 |
| 2,820,628 | 1/1958 | Oishei et al. | 268/125 |
| 2,821,382 | 1/1958 | Oishei et al. | 268/125 |
| 2,909,813 | 10/1959 | Wilson | 49/161 X |
| 3,104,870 | 9/1963 | Kawabata | 268/123 |
| 3,125,334 | 3/1964 | Lohr | 49/358 |
| 3,155,146 | 11/1964 | Malouf et al. | 160/100 X |
| 3,208,298 | 9/1965 | Pickles | 74/411 |
| 3,464,157 | 9/1969 | Rodriguez | 49/161 |
| 3,470,934 | 10/1969 | Agnew | 160/100 X |
| 3,608,241 | 9/1971 | Mazure | 49/72 |
| 3,691,684 | 9/1972 | Boneck | 49/362 X |
| 4,041,645 | 8/1977 | Nourse | 49/347 |
| 4,144,674 | 3/1979 | Dovman | 49/417 |
| 4,553,656 | 11/1985 | Lense | 192/142 |
| 4,835,904 | 6/1989 | Secco | 49/7 |
| 4,837,560 | 6/1989 | Newberry | 340/578 |
| 4,937,976 | 7/1990 | Tucker et al. | 49/345 |
| 5,035,081 | 7/1991 | Yamamoto et al. | 49/161 |

FOREIGN PATENT DOCUMENTS

| | | | |
|---|---|---|---|
| 84901 | 11/1935 | Sweden | 160/100 |
| 363798 | 12/1931 | United Kingdom | 49/361 |
| 454201 | 9/1936 | United Kingdom . | |
| 888715 | 2/1962 | United Kingdom | 20/3 |

*Primary Examiner*—Philip C. Kannan
*Attorney, Agent, or Firm*—Paul & Paul

[57] ABSTRACT

A window assembly is disclosed which provides for automatic raising, lowering and locking of a window unit. The assembly includes a lower window frame having threaded holes in the side members thereof and an upper window frame having a motor mounted thereon. The motor drives a pair of vertical shafts that are threadably engaged within the threaded holes in the side members of the lower frame. Rotation of the vertical shafts causes relative movement of the upper and lower window frames, thereby opening and closing the window unit.

11 Claims, 5 Drawing Sheets

WINDOW MECHANISM

FIELD OF THE INVENTION

The present invention relates to a window mechanism for raising and lowering a window unit. More particularly, the invention relates to an improved means of automatically raising, lowering, and locking, window pane units in any position between a fully closed and fully open position by means of a combination mechanical-electrical system that can be operated by either a wired switch or remote wireless control.

BACKGROUND OF THE INVENTION

The most often used window units presently being installed in residential and commercial buildings, in both old and new units are of the double pane, double-hung variety. The window portion of a conventional window unit is raised and lowered manually, and thus requires either a spring-tensioned system or counterweights to uniformly balance the window, so as to reduce the effect of gravity and friction between the sliding parts of the window unit, and hence reduce the amount of effort required to open and close the windows.

In using conventional window units which require manual force to be applied, it has been observed that such conventional window units oftentimes become stuck and thus require either an inordinate amount of manual force to be applied, or the use of some type of lever, in order to slide the window to either an open or closed position. This occurs when the window unit becomes improperly balanced, thereby increasing the friction between the window pane frame and the outer frame in which it is supported. Consequently, the increase in resistance by friction translates into a greater amount of manual force needed to raise and lower the window.

The use of power operated windows in automobiles is common. However, the mechanisms most often used to operate car windows consist of a plurality of arm members which move along a vertical plane parallel to the plane of the window, either downwardly when lowering the window, or upwardly when closing it. This type of mechanism is awkward, and does not lend itself to being used to operate residential and commercial wall window units.

The present invention has been developed in view of the foregoing and to overcome the disadvantages of the prior art.

SUMMARY OF THE INVENTION

It is an object of the present invention to provide a window mechanism for effortlessly raising and lowering a window which requires no manual upward or downward thrust to be applied.

Another object of this invention is to provide a window mechanism with an improved means of raising and lowering a window unit, wherein the window unit is operated automatically by way of an electric motor, and is maintained in proper balance by the use of guide means acting in combination with the electric motor.

Another object of this invention is to provide a window mechanism having manual-drive capabilities in the event that the electric motor for some reason becomes inoperable.

It is also an object of this invention to provide a wall window unit capable of being tilted inwardly for purposes of cleaning and emergency egress.

It is also an object of this invention to provide a window mechanism having pressure sensing capabilities for safety purposes.

It is a further object of this invention to provide a window mechanism for automatically locking a window in any position between fully closed and fully open, thereby preventing unauthorized entry.

It is another object of this invention to provide an automatic window mechanism that has a minimum of exposed moving parts when installed, thereby improving the aesthetic appearance of the window mechanism and protecting the moving parts from damage.

It is also an object of this invention to provide a window screen that is retracable when not in use and that only extends into the open area created when the window is raised.

These and other objects of the present invention will become more readily apparent from the following description.

BRIEF DESCRIPTION OF THE DRAWINGS

The foregoing summary, as well as the following detailed description will be better understood when read in conjunction with the appended drawings. For the purpose of illustrating the invention, there is shown in the drawings an embodiment which is presently preferred. It is to be understood, however, that this invention is not limited to the precise arrangement and instrumentalities shown.

DESCRIPTION OF THE PREFERRED EMBODIMENT

Figure 1:
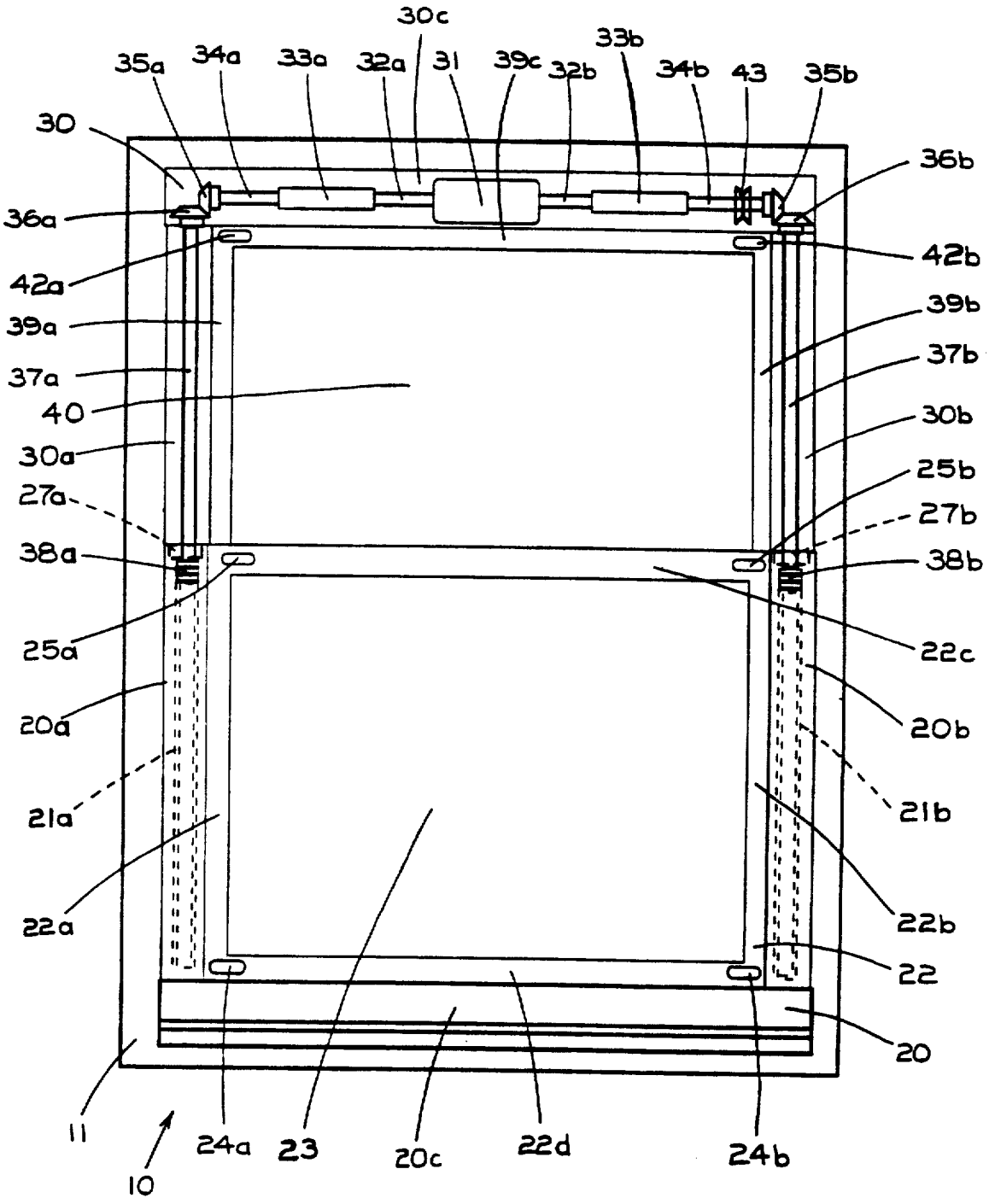
FIG. 1 is a schematic front elevational view of a preferred embodiment of the window assembly of the present invention.

Referring to the drawings, wherein like numerals indicate like elements throughout the several figures, there is shown in FIG. 1 a window assembly of the present invention referred to generally by reference numeral 10. The window assembly 10 of the present invention is disposed within a fixed outer frame 11.

A first window frame member 20 comprises vertical side members **20*a* and 20*b* and horizontal bottom member 20*c*. Disposed within the vertical side members 20*a* and 20*b* are threaded holes 21*a* and 21*b*, respectively, that extend substantially along the entire length of the vertical side members. The first window frame member 20 may be made of any suitable material, including wood, metal or plastic. A separate internally threaded tubing unit may be inserted into the wood, metal or plastic frame to provide the threaded holes 21*a* and 21*b*. In the preferred embodiment, the first window frame member 20** is made of plastic that has been molded with internally threaded holes to form a one piece unit. Such a one piece plastic unit can be provided in any desired color and can be fabricated at low cost.

Figure 2:
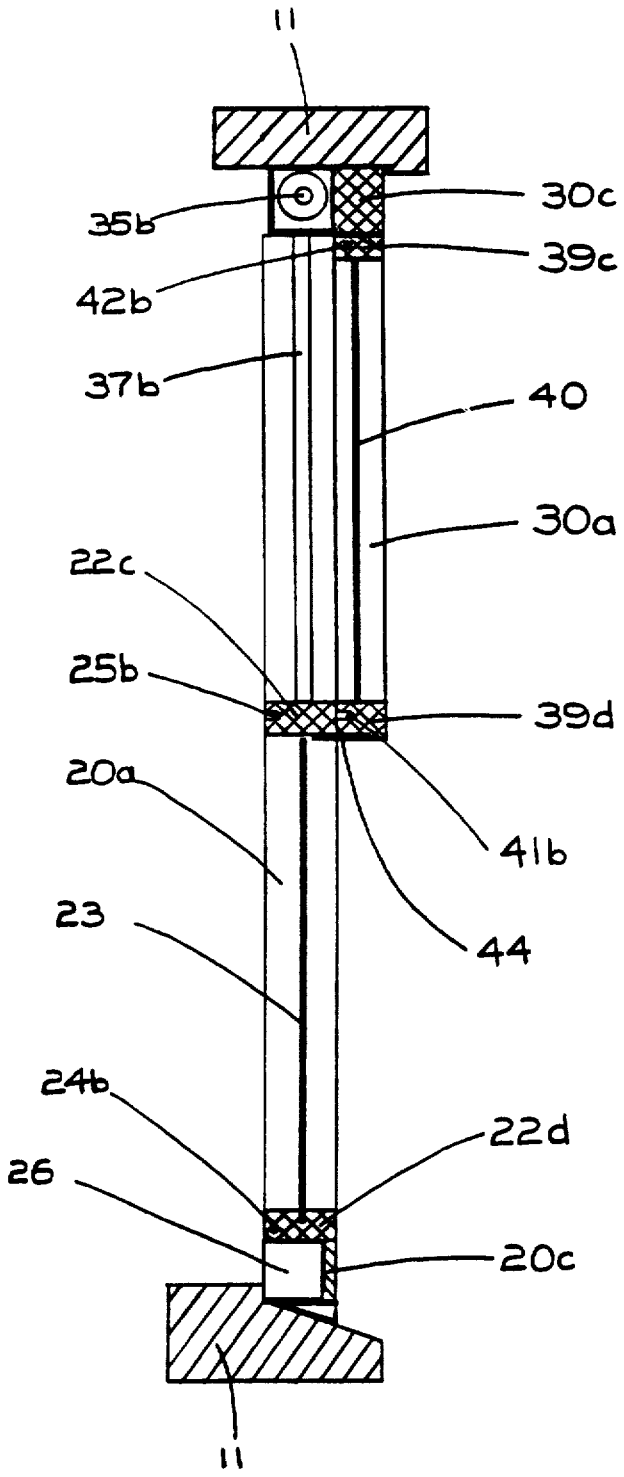
FIG. 2 is a schematic side view of a window assembly of the present invention.
Figure 3:
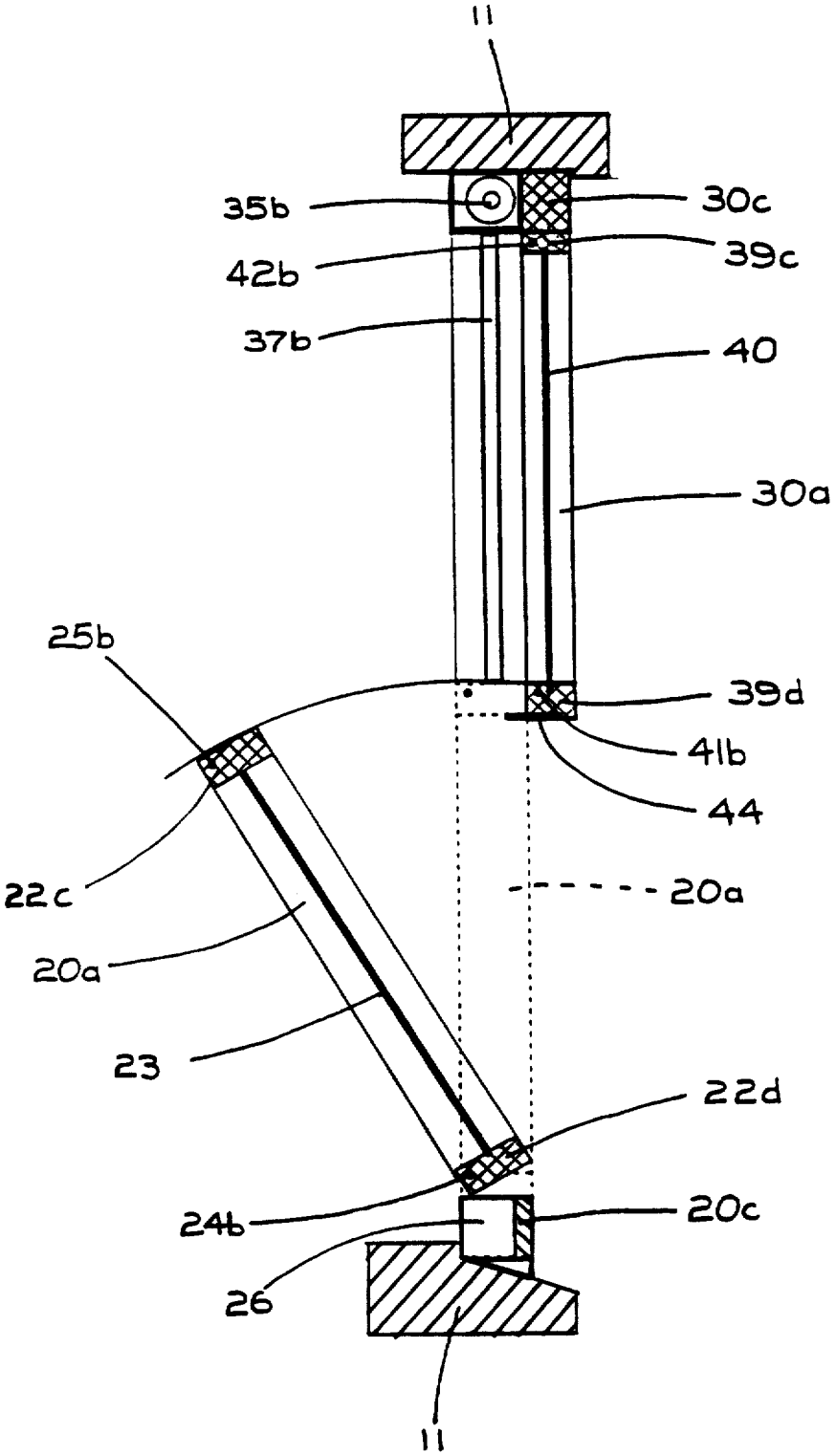
FIG. 3 is a schematic side view of a window assembly of the present invention, illustrating the pivotability of the lower window pane unit.
Figure 4:
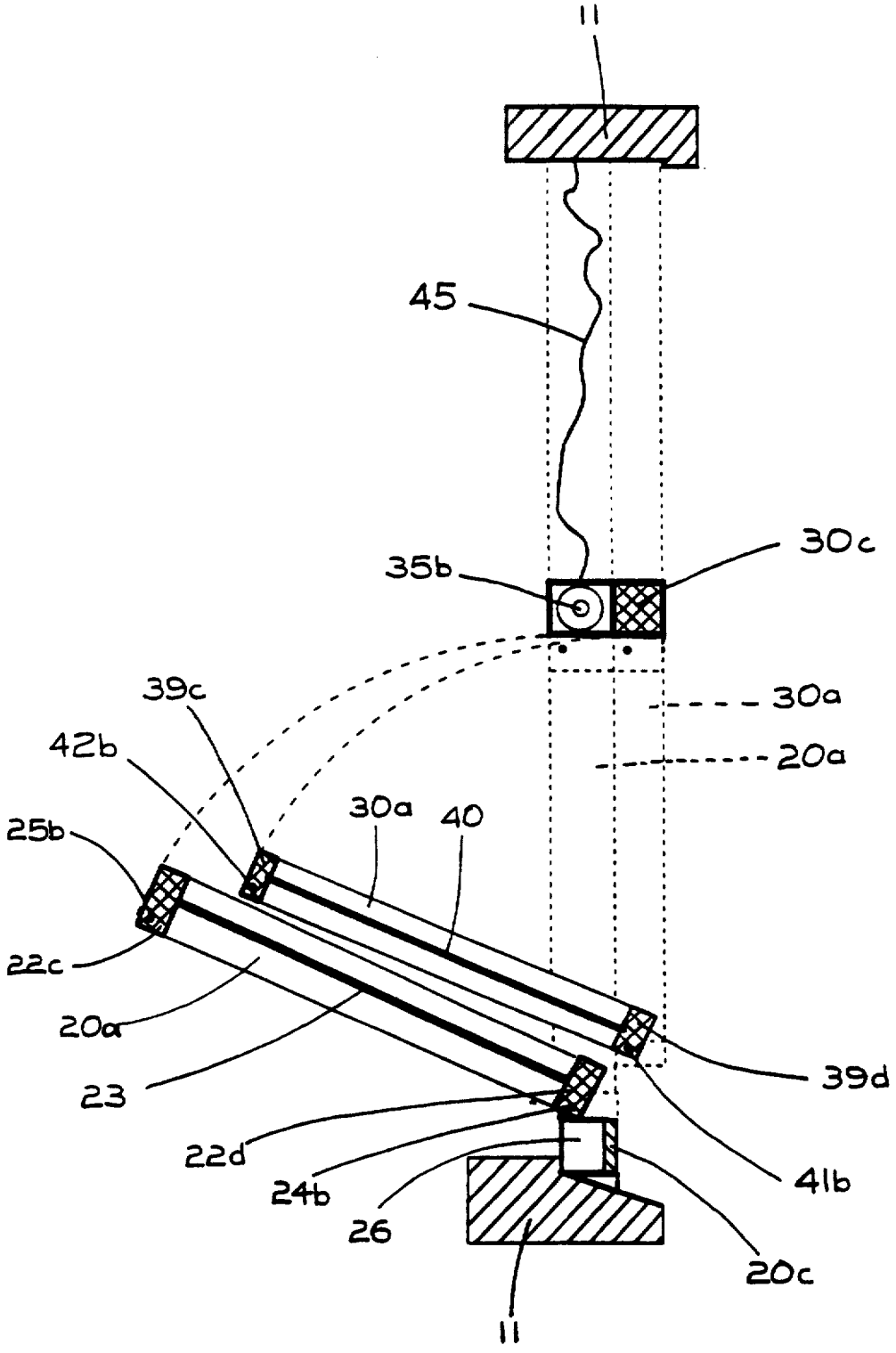
FIG. 4 is a schematic side view of a window assembly of the present invention, illustrating the pivotability of both the lower and upper window pane units.

In the preferred embodiment, a separate subframe 22 is disposed between the vertical side frame members 20a and 20b The subframe 22 includes opposing vertical sections 22a and 22b, and opposing horizontal sections 22c and 22d. A window pane 23 is disposed within the subframe 22 and may be made of any suitable material such as transparent glass or plastic. Although a single pane is shown in FIGS. 2–4, the window pane 23 is preferably of the double pane type comprising two adjacent window panes with a vacuum or gas filled space therebetween. However, it should be understood that any type of suitable window pane panels can be used. In the preferred mode, as shown in FIGS. 2–4, the subframe 22 is rotatably mounted on the vertical side members 20a and 20b of the frame member 20 by pins 24a and 24b located at both sides of the subframe. Securement means 25a and 25b are provided in the subframe 22 for releasably contacting the frame 20. By releasing the securement means 25a and 25b, the subframe 22 and glass pane 23 are free to rotate about the pins 24a and 24b as shown in FIGS. 3 and 4, thus allowing the window pane 23 to be tilted for purposes such as cleaning. The bottom horizontal portion 20c of the frame member 20 optionally contains a screen housing 26 as shown in FIG. 2. The screen housing 26 contains a retractable screen as more fully discussed below.

A second window frame member 30 is provided in accordance with the present invention and comprises vertical side members 30a and 30b and horizontal top member 30c. A motor 31 is attached to the horizontal frame member 30c. The motor 31 is preferably a reversible electrical motor operated by a rocker switch or by a conventional remote control unit. Extending in a horizontal direction from both sides of the motor 31 are shafts 32a and 32b. The shafts 32a and 32b are attached by couplings 33a and 33b to additional shafts 34a and 34b. The couplings 33a and 33b are preferably of the sliding keyed type and permit ease of replacement of the motor 31 if necessary. The horizontal shafts 34a and 34b are attached to a pair of rotatable vertical shafts 37a and 37b by means of miter or bevel gears 35a, 35b, 36a and 36b. While miter or bevel gears are preferred, any other right angle transmission mechanism would be satisfactory. The vertical shafts 37a and 37b are located adjacent to the vertical side members 30a and 30b of the second window frame member 30. The vertical shafts 37a and 37b include threaded end portions 38a and 38b for threadably engaging the threaded holes 21a and 21b in the vertical side members 20a and 20b of the first window frame member 20. The threaded hole 21a and threaded portion 38a of the shaft 37a are threaded in the opposite direction of threaded hole 21b and threaded portion 38b of the shaft 37b because the vertical shafts 37a and 37b rotate in opposite directions during operation.

In the preferred embodiment, a subframe 39 is disposed within the second window frame member 30. The subframe 39 comprises opposing vertical side members 39a and 39b, and opposing horizontal members 39c and 39d. A window pane 40 is secured within the subframe 39 and, although shown as a single pane in FIGS. 2–4, is preferably of the two pane type discussed previously. In the preferred mode, as shown in FIGS. 2–4, the subframe 39 is rotatably mounted to the side members 30a and 30b of the second window frame member 30 by pins 41a and 41b at each side of the subframe. As illustrated in FIG. 4, this configuration allows the window pane 40 and the subframe 39 to rotate about the pins 41a and 41b to allow for tilting. Securement means 42a and 42b are provided on the subframe 39 for releasably contacting the vertical side members 30a and 30b of the second window frame member 30. When the securement means 42a and 42b are retracted, the subframe 39 and window pane 40 are free to rotate about the pins 41a and 41b to allow for cleaning, etc.

A sheave 43 may be provided on the horizontal shaft 34b, or at any other suitable location, in order to permit manual opening or closing of the window in the event of a power failure or motor malfunction. As shown in FIG. 2, a barrier member 44 may be provided on the horizontal frame member 39d which contacts the first window pane 23 to provide a seal against insects and the like when the window is in the open position. Power is provided to the motor 31 by power cord 45 as shown in FIG. 4.

According to the preferred embodiment of the present invention, the vertical rotating shafts 37a and 37b have a smooth surface along almost the entire length thereof, except for the threaded end portions of the shafts 38a and 38b. These threaded end portions are of greater diameter than the smooth portion of the shafts. The threaded portions 38a and 38b preferably cover about ½ to about 1 inch of the bottom ends of the shafts 37a and 37b. Since the diameter of the smooth portion of the shafts 37a and 37b is smaller than the threaded portions 38a and 38b, an opening is provided at the top of the vertical side members 20a and 20b into which washers 27a and 27b are fitted. The washers 27a and 27b include clearance holes of sufficient diameter to allow the smooth portions of the shafts 37a and 37b to pass therethrough. The washers 27a and 27b are preferably attached flush with the top of the vertical side members 20a and 20b with countersunk screws or other means in order to close the opening and improve the appearance thereof. These small threaded sections are always concealed within the threaded holes 21a and 21b of the first window frame 20. Thus, only the smooth faces of the shafts 37a and 37b are visible. In addition, the motor 31, the horizontally rotating shafts 32a, 32b, 34a and 34b and the bevel gears 35a, 35b, 36a and 36b are preferably disposed behind a cover plate which conceals these moving parts from view. Thus, in the preferred embodiment, the window assembly of the present invention does not have any exposed moving parts except for the two smooth vertical rotating shafts 37a and 37b. This provides for a neater appearance in comparison to conventional window assemblies and also prevents damage that can occur with exposed moving mechanisms.

In accordance with the most preferred embodiment of the present invention, both the lower and upper window subframes are secured to their respective window frame members by two upper and two lower sliding bolts. The upper bolts of both subframes are readily accessible on .the front inward faces of the subframes. On the upper subframe 39, the lower sliding bolts are disposed on the lower horizontal frame member 39d and are concealed behind the upper horizontal member 22c of the lower subframe 22 when the windows are closed. Therefore, the lower subframe 22 must be released and tilted inward to gain access to the sliding bolts of the upper subframe 39. These lower sliding bolts 41a and 41b of the upper frame 39 are preferably movable to three positions. In the fully closed position, the bolts 41a and 41b extend from each end of the horizontal member 39*d* of the subframe 39 through the vertical side members 30*a* and 30*b* of the second window frame member 30 and into the vertical side portions of the outer frame member 11. In this fully closed position all relative movement between the subframe 39 and the outer frame member 11 is prevented. In the middle position, the bolts 41*a* and 41*b* extend from each end of the horizontal member 39*d* into the vertical side portions 30*a* and 30*b* of the second window frame member 30, but do not extend into the outer frame member 11. In this center position, the second window frame member 30 is free to slide vertically with respect to the outer frame member 11, with the subframe 39 secured to the frame member 30. When the sliding bolts 41*a* and 41*b* are fully retracted into the horizontal member 39*d*, the entire subframe 39 can be lifted out of the second window frame 30 for cleaning, painting, replacement, etc. The lower sliding bolts 24*a* and 24*b* of the lower subframe 22 may operate in the same manner as the lower sliding bolts of the upper subframe 39 as discussed above and are preferably provided with a cover plate to prevent unauthorized access.

Figure 5:
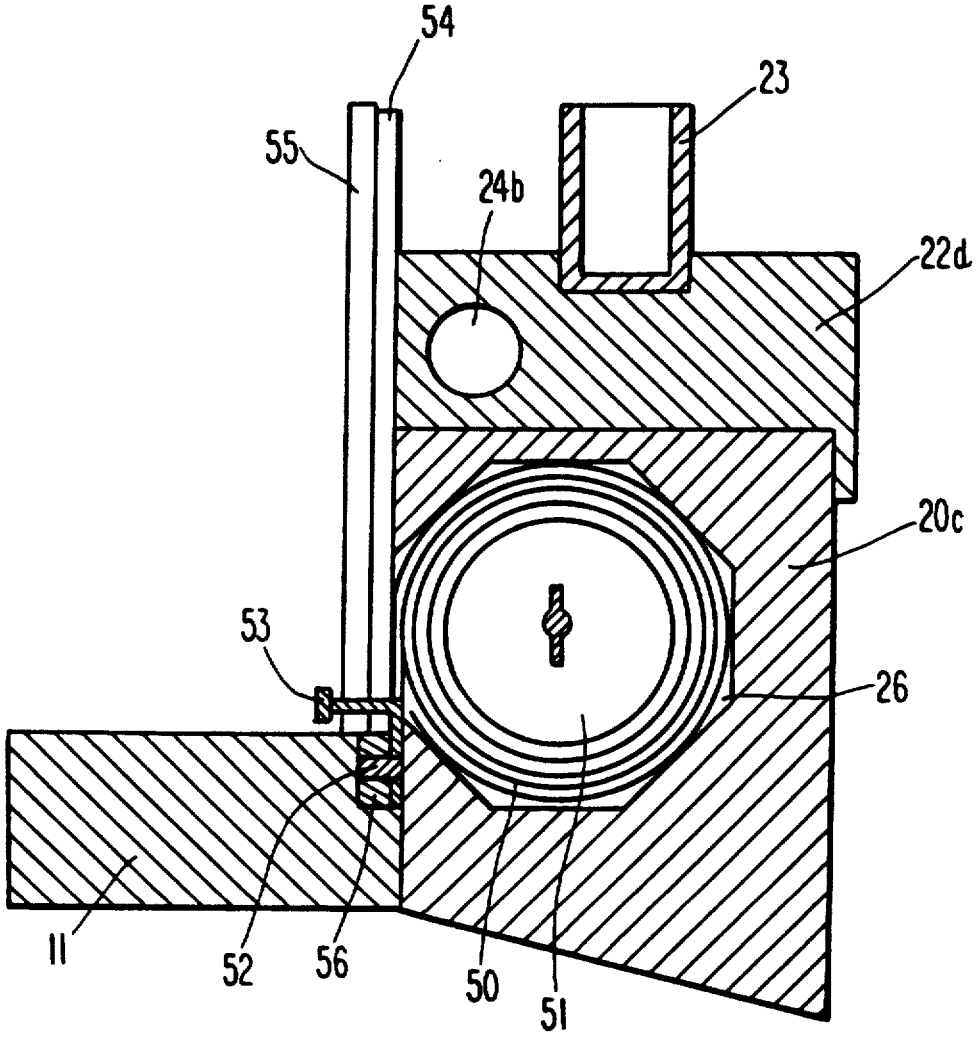
FIG. 5 is an enlarged schematic side view of the optional retracable screen unit of the window assembly of the present invention.

The window assembly of the present invention is optionally provided with a retractable screen 50 as shown most clearly in FIG. 5. A horizontally extending opening 26 is provided in the horizontal member 20*c* of the first window frame member 20. The flexible screen 50 is wound around a roller member 51 disposed within the opening 26. A magnetized bar 56 and at least two pins 52 connect the screen 50 to the window sill 11. An end bar 53 is provided for disconnecting the screen 50. Two vertical magnetized strips are disposed on member 55, which in turn is attached to the outer frame of the window assembly. One such magnetized strip is identified by reference numeral 54 in FIG. 5.

The window assembly of the present invention operates in the following manner. Starting from the closed position as shown in FIGS. 1 and 2, the motor 31 is activated to cause rotation of the horizontal shafts 32*a*, 32*b*, 34*a* and 34*b*. This horizontal rotational motion is transferred by the bevel gears 35*a*, 35*b*, 36*a*, and 36*b* to vertical shafts 37*a* and 37*b*. Due to the engagement of threaded portions 38*a* and 38*b* within the threaded holes 21*a* and 21*b* of the first window frame member 20, rotation of the shafts 37*a* and 37*b* results in the raising of the first window frame member 20. In the simplest mode of operation, the second window frame member 30 is held in a fixed position within the outer frame member 11 and only the first window frame member 20 moves in the vertical direction to thereby open the lower window. Alternatively, the first window frame member 20 can be held in a fixed position relative to outer frame member 11 and the second window frame member 30 can be moveable. In this case, rotation of the vertical shafts 37*a* and 37*b* causes the second window frame member 30 to lower in the vertical direction. In the preferred embodiment, both window frame members 20 and 30 are movable with respect to the outer frame member 11, allowing for raising of the first frame member 20 and lowering of the second window frame member 30. In this double-hung configuration, if movement of only the first window frame 20 is desired, the second window frame member 30 may be connected to the outer frame member 11 via releasable securement means to prevent relative movement thereof. Likewise, if it is desired to only lower the second window frame member 30 while keeping the first window frame member 20 in place, the first window frame member 20 can be releasably secured to the outer frame member 11 to prevent relative movement thereof.

When the window assembly of the present invention is provided with a retractable roll screen as shown in FIG. 5, the rolled screen may be concealed within the lower horizontal member 20*c* of the first window frame member 20. When the first window frame member 20 is moved upwardly in the vertical direction to open the window, the screen 50 unrolls to cover the opening. The screen 50 is preferably made of steel and is secured to the outer frame of the window by the magnetic strip 54 disposed on a portion of the outer frame 55. The screen 50 is wound on a spring tension roller 51 that eliminates slack and permits a tight fit of the screen within the window opening. This retractable screen has the advantage that it is only exposed when the window is in the open position, thereby minimizing damage, deterioration and sources of dirt that adversely affect conventional permanent screens. In addition, when the window assembly is in the closed position and the screen is retracted, light is not blocked as is the case with conventional fixed screens.

The window assembly of the present invention may optionally be provided with a safety feature including a pressure switch that stops operation of the window if a threshold pressure is sensed. Such pressure switches are found in conventional automatic garage door openers and are meant to prevent, for example, a child being accidently injured if the window is automatically or remotely closed.

The window assembly of the present invention possesses several advantages over prior art window assemblies. For example, conventional single and double hung windows require spring tension systems or counterweights to balance the weight of the windows to reduce the resultant effort required to raise and lower the panes. The present invention allows for motorized window operations, thereby eliminating the need for springs or counter weights and the strain of manually lifting windows. This is a particular advantage in the case of handicapped people because the automatic operation of the present assembly allows anyone to open or close a window unit. In addition, once conventional windows are opened, they do not prevent an intruder from raising them further to gain unauthorized entry. The use of the window assemblies of the present invention, incorporating vertical rotating shafts for raising and lowering the window panes, has the advantage of continually locking the window in a fixed position that can only be changed by shaft rotation, instead of applying pressure to the window frame. Furthermore, prior art windows require outside screens that are larger than required, block light and are more subject to damage, deterioration and the collection of dirt. The retractable screen of the present invention overcomes these disadvantages by providing a concealed spring tensioned roll screen that is only exposed in the area of the opening created when the window is raised.

The window assemblies of the present invention are suitable for both new construction and as retrofits for existing buildings. The present window assemblies are advantageously self contained within the limits of typical existing framing and can be made to fit virtually any size window opening.

It will be recognized by those skilled in the art that changes may be made to the above described embodiments of the invention without departing from the broad inventive concepts thereof. For example, while the present disclosure focuses on window assemblies having vertically moving window frame members, the use of horizontally moving window frame members is also possible. It is therefore understood that the present invention is not limited to the particular embodiments disclosed but is intended to cover all modifications which are within the scope and spirit of the invention as defined by the appended claims.

What is claimed is:

1. A window assembly comprising:

a) a first window frame member comprising generally vertical side members disposed adjacent to opposite vertical edges of a first window pane, each of said side members of said first window frame member including a threaded hole therein;

b) a second window frame member comprising a generally horizontal member disposed adjacent to one horizontal edge of a second window pane and generally vertical side members disposed adjacent to opposite vertical edges of said second window pane;

c) drive means attached to said horizontal member of said second window frame member and comprising horizontally rotatable means; and d) a pair of rotatable substantially vertical shafts in driving engagement with said horizontally rotatable means and located adjacent to said vertical side members of said second window frame member, said rotatable vertical shafts comprising threaded portions threadably engaging said threaded holes in said side members of said first window frame member, wherein rotation of said vertical shafts results in relative vertical movement of said first window frame member in relation to said second window frame member.

2. A window assembly according to claim 1, wherein said threaded holes extend substantially through the entire length of each of said side members of said first window frame member.

3. A window assembly according to claim 1, wherein said first window pane is disposed within a subframe that is rotatably mounted on said first window frame member.

4. A window assembly according to claim 1, wherein said second window pane is disposed within a subframe that is rotatably mounted on said second window frame member.

5. A window assembly according to claim 1, wherein said first window frame member is slidably mounted on a fixed outer frame and said second window frame member is nonslidably mounted on said fixed outer frame.

6. A window assembly according to claim 1, wherein said second window frame member is slidably mounted on a fixed outer frame and said first window frame member is nonslidably mounted on said fixed outer frame.

7. A window assembly according to claim 1, wherein said first window frame member and said second window frame member are slidably mounted on a fixed outer frame.

8. A window assembly according to claim 7, wherein said first window frame member comprises means for releasably securing said first window frame member to said fixed outer frame to prevent relative movement therebetween.

9. A window assembly according to claim 7, wherein said second window frame member comprises means for releasably securing said second window frame member to said fixed outer frame to prevent relative movement therebetween.

10. A window assembly according to claim 1, wherein said first window frame member comprises a generally horizontal member disposed adjacent to the lower horizontal edge of said first window pane and having a retractable screen rotatably mounted therein.

11. A window assembly according to claim 10, wherein said first window frame is slidably mounted on a fixed outer frame and said retractable screen comprises vertical side edges that are adapted to be secured to said fixed outer frame by magnetic means when said first window frame member is in an open position.

* * * * *